US012729871B2

(12) United States Patent
Torres et al.

(10) Patent No.: US 12,729,871 B2
(45) Date of Patent: Sep. 8, 2026

(54) HEAT PUMP AND AUXILIARY HEATING WITH CARBON REDUCTION RESET STRATEGY

(71) Applicant: TRANE INTERNATIONAL INC., Davidson, NC (US)

(72) Inventors: Juan M. Torres, Plymouth, MN (US); Lee R. Cline, West Salem, WI (US); Brian A. Kirkman, Shoreview, MN (US); Ronnie R. Moffitt, Harrodsburg, KY (US)

(73) Assignee: TRANE INTERNATIONAL INC., Davidson, NC (US)

( * ) Notice: Subject to any disclaimer, the term of this patent is extended or adjusted under 35 U.S.C. 154(b) by 59 days.

(21) Appl. No.: 18/588,628

(22) Filed: Feb. 27, 2024

(65) Prior Publication Data

US 2025/0271164 A1 Aug. 28, 2025

(51) Int. Cl.

| | |
|---|---|
| ***F24F 11/63*** | (2018.01) |
| ***F24D 19/10*** | (2006.01) |
| ***F24F 110/12*** | (2018.01) |

(52) U.S. Cl.

CPC ..... *F24F 11/63* (2018.01); *F24D 19/1039* (2013.01); *F24D 2200/04* (2013.01); *F24D 2200/08* (2013.01); *F24F 2110/12* (2018.01)

(58) Field of Classification Search

CPC ... F24F 11/63; F24F 2110/12; F24D 19/1039; F24D 2200/04; F24D 2200/08; F24H 15/156; F24H 15/174; F24H 15/219; F24H 15/258; F24H 15/355; F24H 15/429; F24H 15/375

See application file for complete search history.

(56) References Cited

U.S. PATENT DOCUMENTS

| | | | | |
|---|---|---|---|---|
| 9,500,376 | B2 * | 11/2016 | Minamisako | F25B 30/02 |
| 11,624,532 | B2 | 4/2023 | Ryu et al. | |
| 2005/0120729 | A1 * | 6/2005 | Zhang | F25B 9/008 62/183 |
| 2015/0090803 | A1 | 4/2015 | Okamoto et al. | |
| 2021/0262708 | A1 * | 8/2021 | Ryu | F25B 25/005 |
| 2021/0262709 | A1 * | 8/2021 | Ryu | F24D 12/02 |

FOREIGN PATENT DOCUMENTS

| | | | | |
|---|---|---|---|---|
| CN | 107860210 | A * | 3/2018 | A23B 2/90 |
| CN | 108317588 | A * | 7/2018 | F24D 19/1006 |
| EP | 2610558 | A2 * | 7/2013 | F24D 3/18 |
| EP | 3252383 | A1 * | 12/2017 | G05D 23/1923 |
| KR | 970008009 | B1 * | 5/1997 | F24D 15/04 |
| KR | 20110097203 | A * | 8/2011 | F24H 4/04 |

OTHER PUBLICATIONS

Extended European Search Report issued in European Patent Application No. 25160528.3, Jul. 16, 2025 (8 pages).

* cited by examiner

*Primary Examiner* — Kun Kai Ma
(74) *Attorney, Agent, or Firm* — HSML P.C.

(57) ABSTRACT

A heat pump system includes a heat pump and an auxiliary heat source. A heating coefficient of performance is determined for the heat pump based on ambient outdoor air temperatures, and the heat pump is operated to heat a process fluid an output temperature based on the heating coefficient of performance and a reference heating coefficient of performance. The auxiliary heat source can be operated to bring the process fluid to a target temperature for heating a load, with the target temperature being a function of the ambient outdoor air temperatures.

8 Claims, 3 Drawing Sheets

HEAT PUMP AND AUXILIARY HEATING WITH CARBON REDUCTION RESET STRATEGY

FIELD

This disclosure is directed to a heat pump system and an auxiliary heating source configured to utilize the heat pump and the auxiliary heating source according to an effective coefficient of performance.

BACKGROUND

Heat pumps lose heating capacity and efficiency as ambient temperatures go down. At the same time, lower ambient temperatures require higher supply water temperatures to provide sufficient heating.

SUMMARY

This disclosure is directed to a heat pump system and an auxiliary heating source configured to utilize the heat pump and the auxiliary heating source according to an effective coefficient of performance.

By selecting a process fluid supply temperature for a heat pump based on its effective coefficient of performance compared to an auxiliary heating source such as a gas boiler, the operation of the heat pump can be maintained at least at equivalent efficiency and/or carbon output compared to the operation of the auxiliary heating source alone. This can avoid situations where ambient conditions result in heat pump efficiency and/or carbon output being worse than those of the auxiliary heating sources, thereby allowing at least a baseline efficiency and/or carbon output level to be adhered to even under unfavorable ambient conditions such as for example, but not limited to, extreme cold.

In an embodiment, a heating system includes a heat pump configured to supply heat to a process fluid, an auxiliary heating source configured to supply heat to the process fluid, and a controller. The controller is configured to determine a heating coefficient of performance of the heat pump based on an ambient outdoor air temperature, determine a temperature target for the heat pump based on the determined heating coefficient of performance and a reference heating coefficient of performance, and direct operation of the heat pump according to the determined temperature target.

In an embodiment, the controller is further configured to operate the auxiliary heating source to achieve an overall target temperature for the heating system. In an embodiment, the controller is further configured to determine the overall target temperature for the heating system based on the ambient outdoor air temperature. In an embodiment, the overall target temperature for the heating system is determined by a linear function of the ambient outdoor air temperature. In an embodiment, the reference heating coefficient of performance is a heating coefficient of performance of the auxiliary heating source. In an embodiment, the auxiliary heating source is a fossil fuel boiler, or the like. In an embodiment, the auxiliary heating source is an electric boiler, or the like. In an embodiment, the temperature target is determined such that the heating coefficient of performance is equal to or greater than the reference coefficient of performance.

In an embodiment, a method of controlling a heating system includes obtaining, at a controller, an ambient outdoor air temperature. The method further includes determining, using the controller, a coefficient of performance of a heat pump based on the ambient outdoor air temperature. The method also includes determining, using the controller, a target temperature for the heat pump based on the coefficient of performance and a reference coefficient of performance and operating the heat pump to achieve the target temperature in a process fluid.

In an embodiment, the method further includes determining, using the controller, an overall target temperature based on the ambient outdoor air temperature. In an embodiment, the method further includes operating an auxiliary heating source to add heat to the process fluid so as to achieve the overall target temperature. In an embodiment, the reference coefficient of performance is a heating coefficient of performance of the auxiliary heating source. In an embodiment, the auxiliary heating source is a fossil fuel boiler, or the like. In an embodiment, the auxiliary heating source is an electric boiler, or the like. In an embodiment, determining the overall target temperature is based on a linear function of the ambient outdoor air temperature.

DRAWINGS

DETAILED DESCRIPTION

This disclosure is directed to a heat pump system and an auxiliary heating source configured to utilize the heat pump and the auxiliary heating source according to an effective coefficient of performance.

Figure 1:
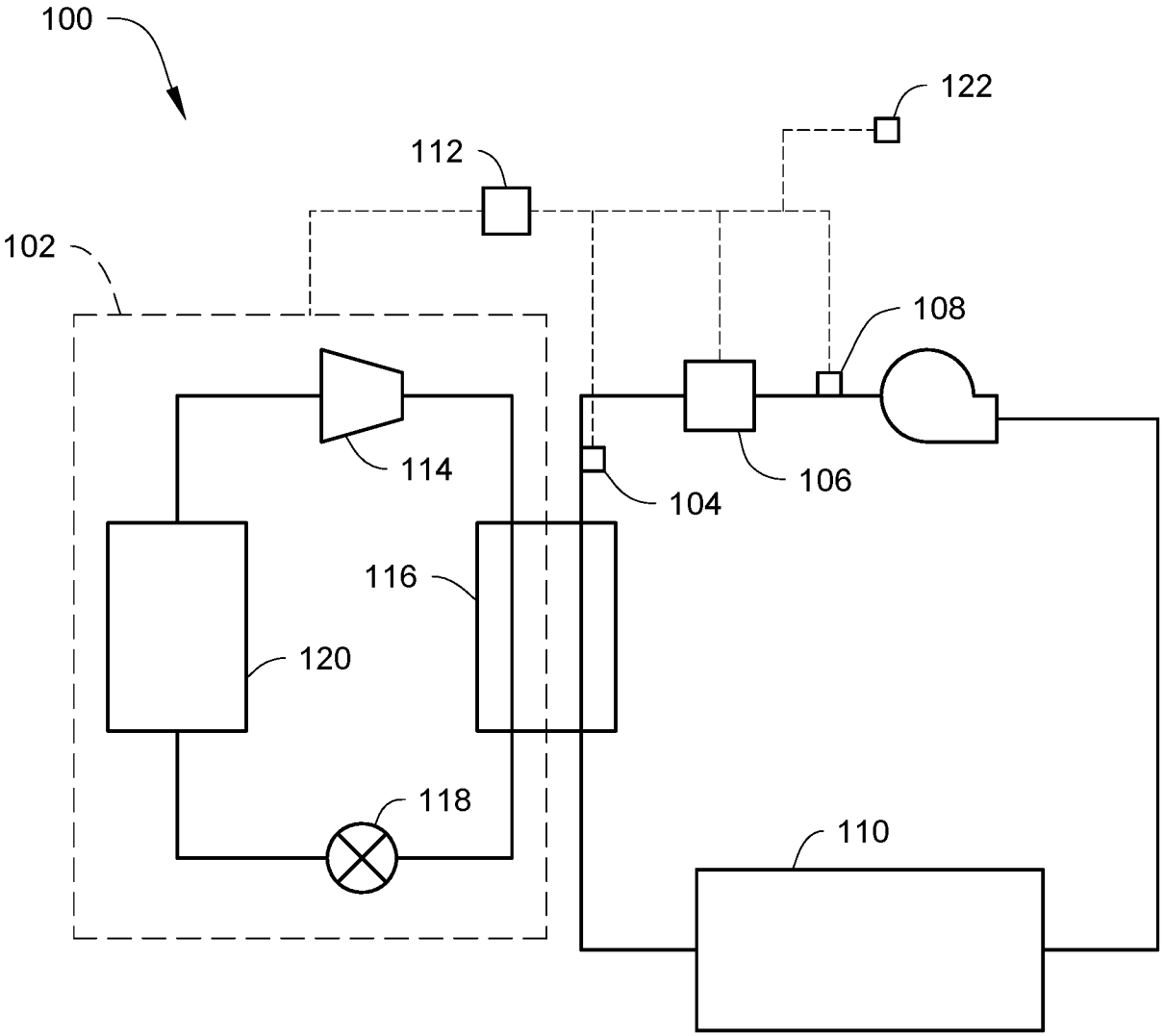
FIG. 1 shows a heat pump system according to an embodiment.

FIG. 1 shows a heat pump system according to an embodiment. Heat pump system 100 includes heat pump 102, heat pump outlet temperature sensor 104, auxiliary heater 106, supply temperature sensor 108, and load 110. Heat pump system 100 further includes ambient temperature sensor 122 and a controller 112.

Heat pump system 100 is configured to circulate a process fluid to thereby provide at least heating to a load 110 by adding heat to the process fluid, and the process fluid releasing heat at said load 110. Heat pump system 100 can be installed, for example, in climates where ambient temperatures can occasionally be below temperatures where the heat pump 102 can be operated efficiently. Heat pump system 100 can further include any suitable arrangement of fluid lines, valves, pumps, and the like to circulate the process fluid to load 110 and heat sources including heat pump 102 and auxiliary heater 106.

Heat pump 102 is a heat pump configured to extract heat from a source such as an ambient environment and to provide heat to the process fluid. Heat pump 102 can be configured to be operated to heat the process fluid so as to achieve a target temperature for the output of said heat pump 102. In embodiments, the heat pump 102 can be one or more modular heat pump units, a reversible heat pump, a chiller-heater unit, or any other suitable heat pump device. In an embodiment, at least some components of heat pump 102, such as compressor 114, fans, controls or actuators for expander 118, and the like are electrically powered. In an embodiment, all powered components of the heat pump 102 are electrically powered. Heat pump 102 can have a heating coefficient of performance that is a function of a source temperature of a heat source used by heat pump 102, for example, and ambient outdoor air temperature, and further a function of a target temperature to be achieved by the heat pump 102. The heating coefficient of performance of heat pump 102 can be a function of the ambient outdoor air temperature, with a different function providing the heating coefficient of performance for each selected target output temperature for heat pump 102. For example, for higher target output temperatures for heat pump 102, the heating coefficient of performance can be relatively lower compared to a lower target output temperature at the same ambient outdoor air temperature value.

Heat pump 102 can include any suitable working fluid circuit for generating heat to be supplied to the process fluid. In a non-limiting example, heat pump 102 can include a compressor 114, a condenser 116, an expander 118, and an evaporator 120. The compressor 114 is configured to compress a working fluid. Compressor 114 can be any suitable compressor, such as a screw compressor, a scroll compressor, a centrifugal compressor, or the like. Working fluid from compressor 114 can pass to condenser 116. Condenser 116 is a heat exchanger allowing the working fluid to reject heat to the process fluid, thereby heating the process fluid of heat pump system 100. The working fluid can pass from condenser 116 to expander 118. At expander 118 the working fluid is expanded. Expander 118 can be any suitable expander, such as at least one expansion valve, expansion orifice, orifice plate, expansion nozzle, combinations thereof, or the like. Working fluid can pass from expander 118 to evaporator 120 where the working fluid can extract heat from a source such as the ambient air, thereby evaporating the working fluid prior to the working fluid returning to compressor 114. In some embodiments, the heat pump 102 can include any other suitable valves, piping, and/or other components, such as flow reverser of a reversible heat pump circuit, or the like.

Heat pump outlet sensor 104 is a temperature sensor configured to measure a temperature of the process fluid as it leaves the heat pump 102, for example at an outlet of the condenser 116 of the heat pump 102. The heat pump outlet sensor 104 can be used in control of the heat pump 102, such that the heat pump 102 achieves a desired target temperature. Heat pump outlet sensor 104 can be positioned at an outlet of the heat pump 102, along a fluid line directly downstream of the heat pump 102, or any other suitable position for determining the outlet temperature of the heat pump 102.

Auxiliary heater 106 can be any suitable heater for adding heat to the process fluid of heat pump system. In an embodiment, the auxiliary heater 106 can be a heater which does not rely on ambient conditions for the capacity to supply heat. For example, auxiliary heater 106 can be a fossil fuel boiler such as a natural gas boiler, an oil-fueled boiler, or the like, an electric boiler such as an electric resistance heating, or the like. In an embodiment, auxiliary heater 106 can be a heat pump having a relatively lower efficiency under typical conditions compared to heat pump 102, but may be adapted to provide higher efficiency at a lower range of temperatures compared to the heat pump 102. In an embodiment, a coefficient of performance of the auxiliary heater is a known value. In an embodiment, auxiliary heater 106 is downstream of the heat pump 102 with respect to a direction of flow of the process fluid. In an embodiment where the auxiliary heater 106 is a fossil fuel boiler, the heating coefficient of performance of said auxiliary heater 106 can be in a range from 0.8 to 0.95, based on return and target supply temperatures, heater design, fuel type, combustion type and the like. In an embodiment where the auxiliary heater 106 is an electric boiler, the heating coefficient of performance of said auxiliary heater 106 can be at or about 1. The heating coefficient of performance of auxiliary heater 106 can be used to estimate a carbon dioxide output of operations of heater 106 to provide a level of heating. Auxiliary heater 106 can be operated such that the temperature of the process fluid supplied to load 110 reaches an overall target temperature selected to satisfy the heating demand of load 110. In an embodiment, auxiliary heater 106 can be positioned downstream of the heat pump 102, such that the heat pump 102 can add heat to the process fluid prior to any other heating of the process fluid by an auxiliary heater 106.

Supply temperature sensor 108 is an optional temperature sensor configured to measure the temperature of the process fluid being directed to load 110. The supply temperature sensor 108 can be positioned at any suitable position, for example at an outlet of auxiliary heater 106, along a fluid line from the auxiliary heater 106 to the load 110, or the like.

Load 110 is a heating load serviced by heat pump system 100. Load 110 can include one or more conditioned spaces provided in one or more buildings serviced by the heat pump system 100. Load 110 can include one or more heat exchangers where the process fluid can provide heat to, for example, air to be circulated within one or more conditioned spaces of the load 110. In an embodiment, the load 110 can include a plurality of terminals each including at least one of the heat exchangers.

Controller 112 is configured to control the operation of heat pump system 100, including, for example, heat pump 102 and auxiliary heater 106. Controller 112 can be configured to obtain temperature readings from at least one of heat pump outlet sensor 104 and supply temperature sensor 108. Controller 112 can further be configured to obtain an ambient outdoor air temperature, for example from a weather service, an outdoor temperature sensor 122, or any other suitable source for the ambient outdoor air temperature. Controller 112 can be configured to receive or otherwise obtain an ambient outdoor air temperature, determine an overall target temperature for providing heating to the load 110, determine a heating coefficient of performance of the heat pump 102, and/or determine a target temperature for the heat pump 102 to supply based on the heating coefficient of performance of the heat pump and a reference heating coefficient of performance. In an embodiment, the controller 112 can determine the target temperature for the heat pump 102 such that the heating coefficient of performance of operating the heat pump to provide the determined temperature is at or above the reference heating coefficient of performance. In an embodiment, the reference heating coefficient of performance is based on the characteristics of the auxiliary heater 106. In an embodiment, the reference heating coefficient of performance is a predetermined value. In an embodiment, the reference heating coefficient of performance can be based on or scaled by electric grid efficiency and/or grid carbon output for the region where the heat pump system 100 is installed. Non-limiting examples of operations that can be performed by controller 112 are further shown in FIG. 2 and described in detail below.

Figure 2:
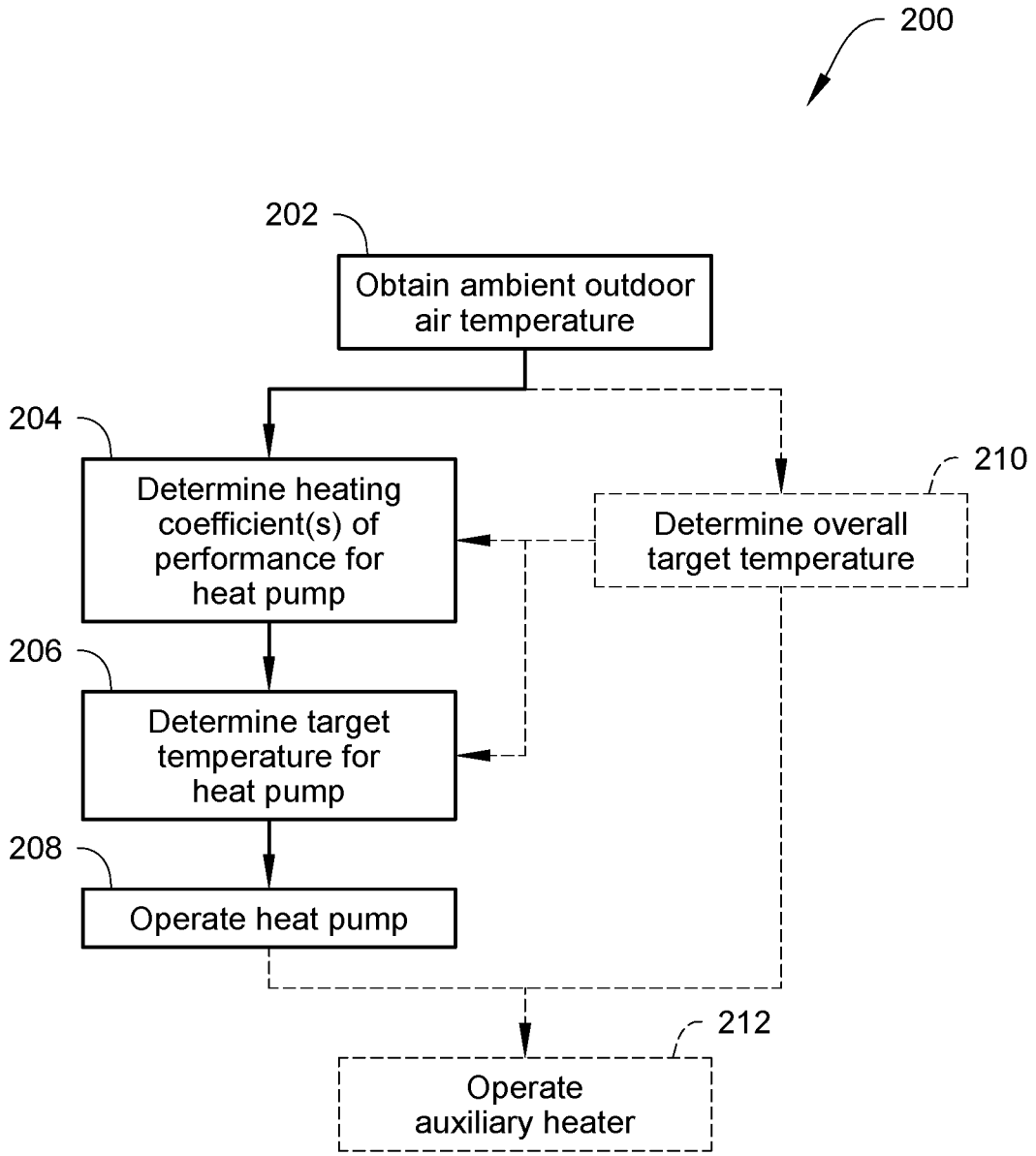
FIG. 2 shows a method of operating a heat pump and an auxiliary heater according to an embodiment.

FIG. 2 shows a method of operating a heat pump and an auxiliary heater according to an embodiment. Method 200 includes obtaining an ambient outdoor air temperature 202, determining a heating coefficient of performance for a heat pump 204, determining a target temperature for the heat pump 206, and operating the heat pump to achieve the target temperature 208. Method 200 further optionally includes determining an overall target temperature 210, and operating an auxiliary heating source to achieve the overall target temperature 212.

Method 200 can coordinate operation of a heat pump and an auxiliary heater such that the heat pump can contribute to satisfying heating loads when the heat pump is capable of operating at or greater than a reference coefficient of performance, and using the auxiliary heater when required to satisfy the heating load(s). Method 200 can be performed, for example, in a heat pump system such as heat pump system 100 described above and shown in FIG. 1. In an embodiment, method 200 can be performed whenever the heat pump system is being operated to supply heat to a heating load. In an embodiment, method 200 can be performed at certain predetermined temperatures or when within predetermined ranges of temperatures, for example based on characteristics and known efficiency levels for the heat pump, or the like. For example, method 200 can be performed when ambient temperatures are within a range where the heat pump experiences diminished efficiency but is known to be capable of at least limited operation at or above the reference coefficient of performance, for example when temperatures may be between 0° F. and 20° F. or lower.

An ambient outdoor air temperature is obtained at 202. The ambient outdoor air temperature can be obtained at 202 from one or more readings from one or more ambient outdoor air temperature sensors, can be received from a service such as a weather service, or the like. The ambient outdoor air temperature obtained at 202 can be indicative of both heating needs for a heating load and of an efficiency of operations of a heat pump.

One or more heating coefficients of performance for the heat pump are determined at 204. The heating coefficient(s) of performance can be based on the ambient outdoor air temperature obtained at 202. In an embodiment, heating coefficients of performance can be determined at 204 for each of one or more output process fluid temperatures for the heat pump. The output process fluid temperatures for which heating coefficients of performance can be selected based on the ambient outdoor air temperature, for example a value to fully satisfy the heating load, various values at incremental steps below full satisfaction of the heating load, or the like. In an embodiment, based on the ambient outdoor air temperature, a function can be provided that relates output process fluid temperature to the heating coefficient of performance of the heat pump.

A target temperature for the heat pump is determined at 206. The target temperature determined at 206 is a temperature for the heat pump to achieve when the heat pump is operated to add heat to the process fluid. The target temperature for the heat pump can be determined based on the heating coefficient(s) of performance determined at 204. The target temperature for the heat pump determined at 206 can be based at least partially on a reference heating coefficient of performance. In an embodiment, the target temperature determined for the heat pump at 206 can be determined such that the heating coefficient of performance for achieving the target temperature is at or above the reference heating coefficient of performance. The reference heating coefficient of performance can be a minimum threshold for operation of the heat pump to be advantageous as a heat source. In an embodiment, the reference heating coefficient of performance can be based on the energy consumption and/or carbon output resulting from operation at said reference heating coefficient of performance. In an embodiment, the reference heating coefficient of performance is a predetermined value. In an embodiment, the reference heating coefficient of performance can be partially based on or scaled according to a carbon output of electrical energy at the location of the heat pump system, electrical grid efficiency at the location of the heat pump system, and/or any other suitable factor for associating local efficiency of the heat pump with an overall carbon output, energy cost, combinations thereof, or the like. In an embodiment, the reference heating coefficient of performance is based on a target efficiency level. In an embodiment, the reference heating coefficient of performance is based on a heating coefficient of performance of alternative heat sources for the heating load serviced by the heat pump system, for example, the auxiliary heating source. For example, the reference heating coefficient of performance can be a value determined based on a grid carbon emissions rate for a region and/or an efficiency of a standard boiler, such as a 90% efficient natural gas boiler. A non-limiting example of a reference heating coefficient of performance is a 2.0 heating coefficient of performance (COPh). In an embodiment, the reference heating coefficient of performance can be determined based on a mean grid carbon emissions rate for a national grid. In an embodiment, the reference heating coefficient of performance can be determined based on more granular information regarding grid carbon emissions rates, such as for smaller regions, particular installations, or the like. In an embodiment, the target temperature for the heat pump can be selected such that the heat pump provides heating to the extent that the heat pump is at least as efficient as the alternative heat source. For example, the target temperature can be determined at 206 can have a heating coefficient of performance that meets or exceeds the reference coefficient of performance. In an embodiment, the target temperature for the heat pump can match a temperature to satisfy the heating load when such a temperature can be obtained while the heating coefficient of performance of the heat pump under the present ambient conditions meets or exceeds the reference coefficient of performance. In an embodiment, the target temperature for the heat pump can be a target temperature where the heating coefficient of performance matches the reference heating coefficient of performance under the present ambient conditions.

The heat pump is operated to achieve the target temperature for said heat pump at 208. Operation of the heat pump includes operation of the working fluid circuit thereof, such that the process fluid is heated to the target temperature for the heat pump. The operation of the heat pump can be controlled to achieve the target temperature through control of elements including, but not limited to, the operation of the compressor, the expander, control of a rate of flow of the process fluid through the one or more heat exchangers of the working fluid circuit of the heat pump, operation of fans at an outdoor heat exchanger of the heat pump, or any other suitable control variable or combination thereof affecting the output temperature of the process fluid from the heat pump.

An overall target temperature can be determined at 210. The overall target temperature determined at 210 can be a temperature for the process fluid when it is directed to the heating load such that the process fluid can satisfy the heating requirements at the heating load. The overall target temperature determined at 210 can be based on the ambient outdoor air temperature obtained at 202. In an embodiment, the overall target temperature can be determined at 210 as a linear function of the ambient outdoor air temperature obtained at 202. The overall target temperature determined at 210 is a target temperature for the process fluid such that the heating load can be satisfied by the process fluid being provided at said target temperature. The overall target temperature determined at 210 can optionally also be used in determination of the coefficients of performance at 204 and/or determination of the target temperature for the heat pump at 206.

An auxiliary heating source can be operated to achieve the overall target temperature at 212. The auxiliary heating source can be, for example, a fossil fuel boiler such as a natural gas boiler, an electric resistance heating boiler, or the like. When the determined temperature determined for the heat pump at 206 according to the reference heating coefficient performance is less than the overall target temperature determined at 210, the auxiliary heating source can be operated to add further heat to the process fluid, such that the process fluid is at the overall target temperature when the process fluid is circulated to the heating load. In an embodiment, the auxiliary heating source is downstream of the heat pump with respect to the flow of the process fluid, and receives the process fluid from the heat pump that can then be further heated by the auxiliary heating source so as to achieve the overall target temperature at 212. In an embodiment, the auxiliary heating source can be the sole heater operating to raise the temperature of the process fluid to the overall target temperature when ambient temperatures prevent the heat pump from operating at least at the reference heating coefficient of performance. In an embodiment, the auxiliary heating source is not operated at 212 when the temperature determined for the heat pump at 206 matches the overall target temperature.

Figure 3:
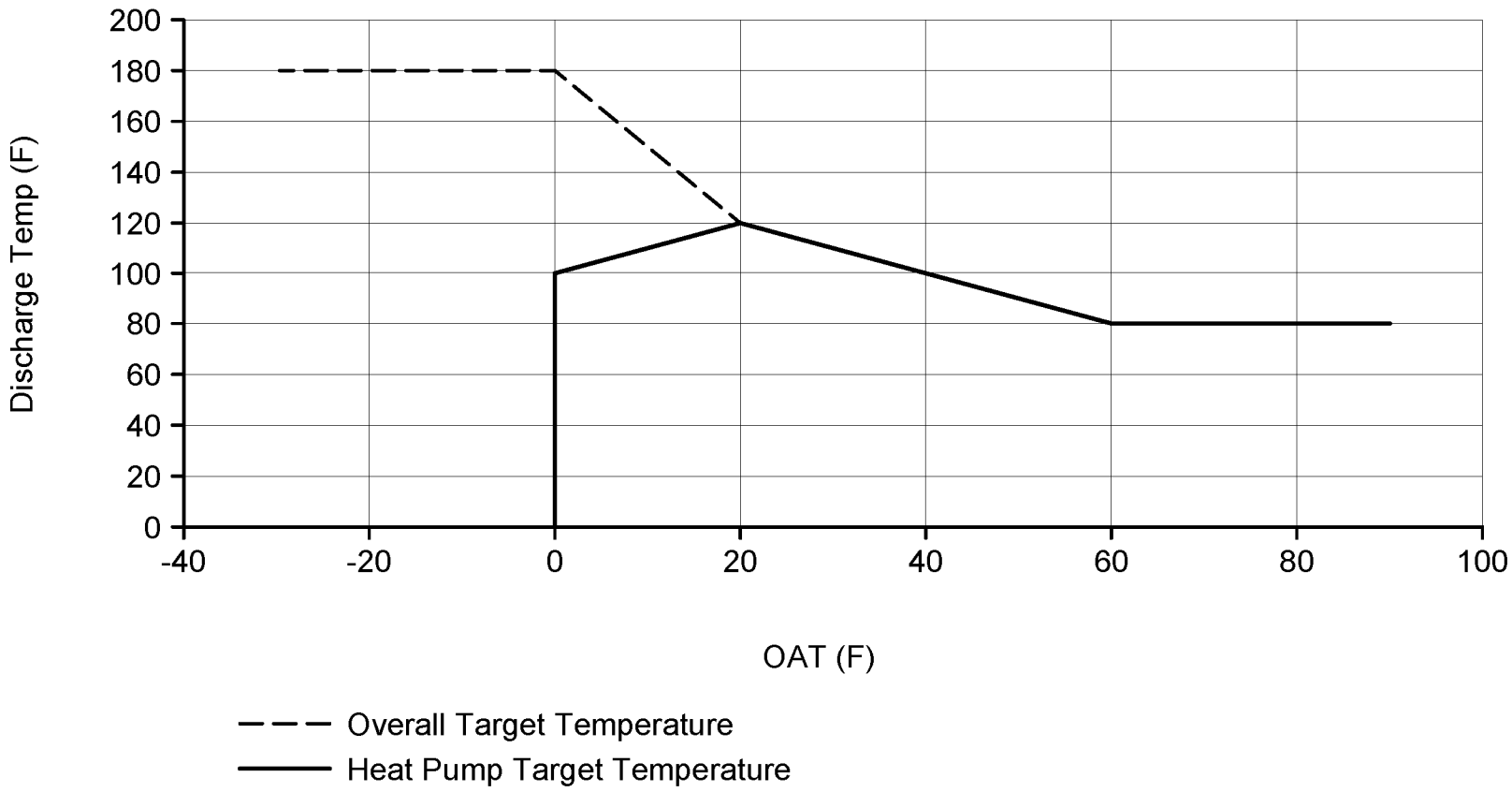
FIG. 3 shows a chart of temperature set points for a heat pump and an auxiliary heating based on ambient temperatures according to an embodiment.

FIG. 3 shows a chart of temperature set points for a heat pump and an auxiliary heating based on ambient temperatures according to an embodiment. In the example chart of temperature set points shown in FIG. 3, when the outdoor air temperature (OAT) falls below 60° Fahrenheit (F), demand for heating increases and the target temperature for the heat pump increases linearly as temperatures fall from 60° F. to 20° F., such that the supplied heated process fluid is capable of meeting the heating demand of the heating load. Over the range from 60° F. to 20° F., the heat pump is capable of providing the target temperature while having a heating coefficient of performance above or at the reference heating coefficient of performance. Since the heat pump is more energy- and/or carbon-emission-efficient than the auxiliary heater in satisfying heating requirements in this range, the heat pump is operated to meet the entire heating demand. As ambient temperatures fall into the range from 20° F. to 0° F., the heating coefficient of performance of the heat pump is diminished, however, the overall target temperature for the process fluid to satisfy the heating load continues to increase. Accordingly, the output temperature of the heat pump can be reduced to output temperatures that can be delivered at a heating coefficient of performance of the heat pump that meets or exceeds the reference heating coefficient of performance. The difference between the output temperature of the heat pump and an overall target temperature for satisfying the heating load is provided by operation of the auxiliary heater, which is, for example, a gas or electric boiler and thus provides a coefficient of performance that is minimally or not affected by ambient temperatures. Accordingly, the overall output temperature can continue to increase with the heating demand, while still utilizing some of the heat pump's capacity to deliver the heating at or above the reference heating coefficient of performance. In the example shown in FIG. 3, below 0° F., heating can be provided entirely by the auxiliary heater, and the heat pump can be deactivated as the heat pump is incapable of performing or has efficiency below the reference coefficient of performance under such ambient outdoor air temperature conditions.

ASPECTS

It is understood that any of aspects 1-8 can be combined with any of aspects 9-15.

Aspect 1. A heating system, comprising:

a heat pump configured to supply heat to a process fluid;

an auxiliary heating source configured to supply heat to the process fluid;

a controller, configured to:

determine a heating coefficient of performance of the heat pump based on an ambient outdoor air temperature;

determine a temperature target for the heat pump based on the determined heating coefficient of performance and a reference heating coefficient of performance; and direct operation of the heat pump according to the determined temperature target.

Aspect 2. The heating system according to aspect 1, wherein the controller is further configured to operate the auxiliary heating source to achieve an overall target temperature for the heating system.

Aspect 3. The heating system according to aspect 2, wherein the controller is further configured to determine the overall target temperature for the heating system based on the ambient outdoor air temperature.

Aspect 4. The heating system according to aspect 3, wherein the overall target temperature for the heating system is determined by a linear function of the ambient outdoor air temperature.

Aspect 5. The heating system according to any of aspects 1-4, wherein the reference heating coefficient of performance is a heating coefficient of performance of the auxiliary heating source.

Aspect 6. The heating system according to any of aspects 1-5, wherein the auxiliary heating source is a fossil fuel boiler.

Aspect 7. The heating system according to any of aspects 1-5, wherein the auxiliary heating source is an electric boiler.

Aspect 8. The heating system according to any of aspects 1-7, wherein the temperature target is determined such that the heating coefficient of performance is equal to or greater than the reference coefficient of performance.

Aspect 9. A method of controlling a heating system, comprising:

obtaining, at a controller, an ambient outdoor air temperature;

determining, using the controller, a coefficient of performance of a heat pump based on the ambient outdoor air temperature;

determining, using the controller, a target temperature for the heat pump based on the coefficient of performance and a reference coefficient of performance; and operating the heat pump to achieve the target temperature in a process fluid.

Aspect 10. The method according to aspect 9, further comprising determining, using the controller, an overall target temperature based on the ambient outdoor air temperature.

Aspect 11. The method according to aspect 10, further comprising operating an auxiliary heating source to add heat to the process fluid so as to achieve the overall target temperature.

Aspect 12. The method according to aspect 11, wherein the reference coefficient of performance is a heating coefficient of performance of the auxiliary heating source.

Aspect 13. The method according to any of aspects 11-12, wherein the auxiliary heating source is a fossil fuel boiler.

Aspect 14. The method according to any of aspects 11-12, wherein the auxiliary heating source is an electric boiler.

Aspect 15. The method according to any of aspects 10-15, wherein determining the overall target temperature is based on a linear function of the ambient outdoor air temperature.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A heating system, comprising:

a heat pump configured to supply heat to a process fluid;

an auxiliary heating source configured to supply heat to the process fluid;

a controller, configured to:

determine a heating coefficient of performance of the heat pump based on an ambient outdoor air temperature;

determine a temperature target for the heat pump based on the determined heating coefficient of performance and a reference heating coefficient of performance; and direct operation of the heat pump according to the determined temperature target, wherein the controller is further configured to operate the auxiliary heating source to achieve an overall target temperature for the heating system, wherein the controller is further configured to determine the overall target temperature for the heating system based on the ambient outdoor air temperature, and wherein the overall target temperature for the heating system is determined by a linear function of the ambient outdoor air temperature.

2. The heating system of claim 1, wherein the reference heating coefficient of performance is a heating coefficient of performance of the auxiliary heating source.

3. The heating system of claim 1, wherein the auxiliary heating source is a fossil fuel boiler.

4. The heating system of claim 1, wherein the auxiliary heating source is an electric boiler.

5. A method of controlling a heating system, comprising:

obtaining, at a controller, an ambient outdoor air temperature;

determining, using the controller, a coefficient of performance of a heat pump based on the ambient outdoor air temperature;

determining, using the controller, a target temperature for the heat pump based on the coefficient of performance and a reference coefficient of performance, wherein the target temperature is determined such that the coefficient of performance is equal to or greater than the reference coefficient of performance and wherein the reference coefficient of performance is at least partially based on one or more of carbon output, energy cost, or target efficiency level;

determining, using the controller, an overall target temperature based on the ambient outdoor air temperature; and operating the heat pump and an auxiliary heating source to add heat to a process fluid to achieve the overall target temperature in the process fluid;

wherein determining the overall target temperature is based on a linear function of the ambient outdoor air temperature.

6. The method of claim 5, wherein the reference coefficient of performance is a heating coefficient of performance of the auxiliary heating source.

7. The method of claim 5, wherein the auxiliary heating source is a fossil fuel boiler.

8. The method of claim 5, wherein the auxiliary heating source is an electric boiler.

* * * * *